United States Patent [19]

Kilpatrick et al.

[11] Patent Number: 5,035,639

[45] Date of Patent: Jul. 30, 1991

[54] HERMAPHRODITIC ELECTRICAL CONNECTOR

[75] Inventors: Jerry B. Kilpatrick, Greensboro, N.C.; Clifford F. Lincoln, Atlanta, Ga.

[73] Assignee: AMP Incorporated, Harrisburg, Pa.

[21] Appl. No.: 496,471

[22] Filed: Mar. 20, 1990

[51] Int. Cl.[5] ..... H01R 25/00

[52] U.S. Cl. ..... 439/290; 439/850; 439/889

[58] Field of Search ..... 439/286–288, 439/290, 291, 850, 856, 857, 883, 889

[56] References Cited

U.S. PATENT DOCUMENTS 741,052 10/1903 Mahon ..... 439/290

2,785,387 3/1957 Batcheller ..... 439/290

3,202,954 8/1965 Kinkaid ..... 439/290

3,634,811 1/1972 Teagno et al. ..... 439/290

*Primary Examiner*—Paula A. Bradley

*Attorney, Agent, or Firm*—Eric J. Groen; Robert W. Pitts

[57] ABSTRACT

Hermaphroditic electrical terminals positioned within hermaphroditic insulative housings are suitable for electrical power distribution. Each terminal has an inclined contact arm opposed to a generally flat contact arm. Both contact arms are longitudinally coined. Each generally flat contact arm is sandwiched between the two arms of the other terminal when the two terminals are mated. The convex coined surfaces on the inclined arms engage concave coined surfaces on the generally flat contact of the other terminal to maintain the line contact between convex coined surfaces on the generally flat contact arms in static equilibrium.

7 Claims, 5 Drawing Sheets

Fig. 9
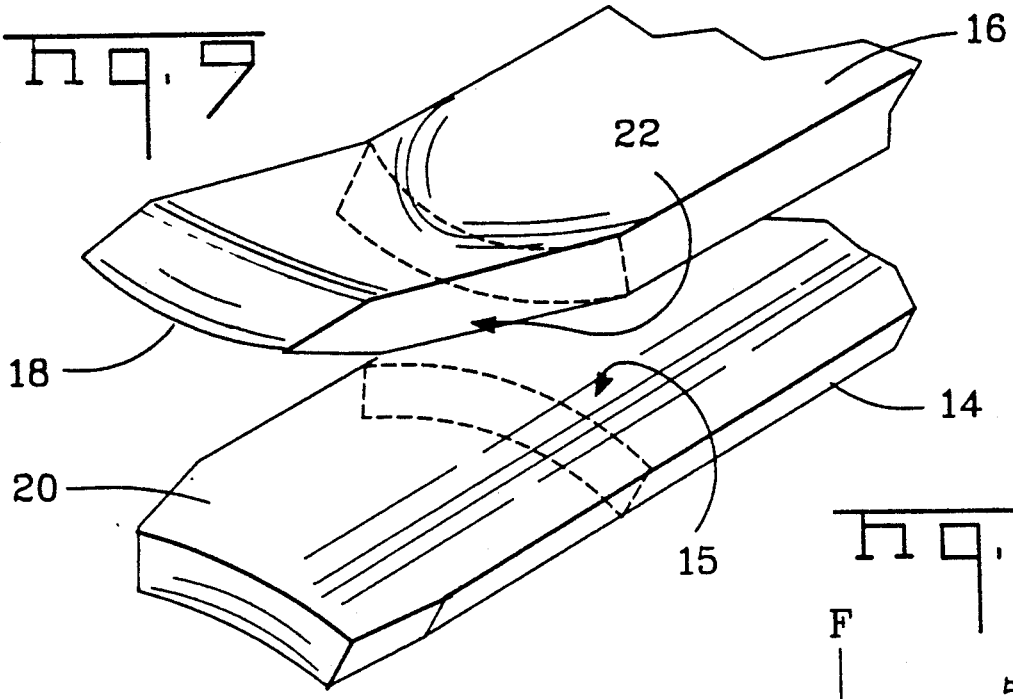
Fig. 11
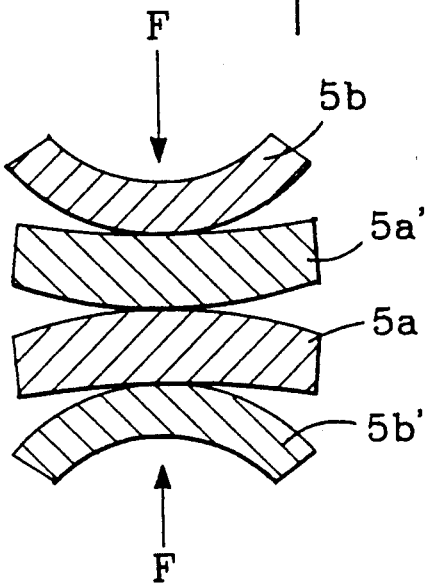
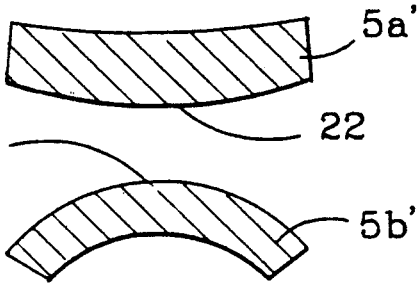
Fig. 10
Fig. 12
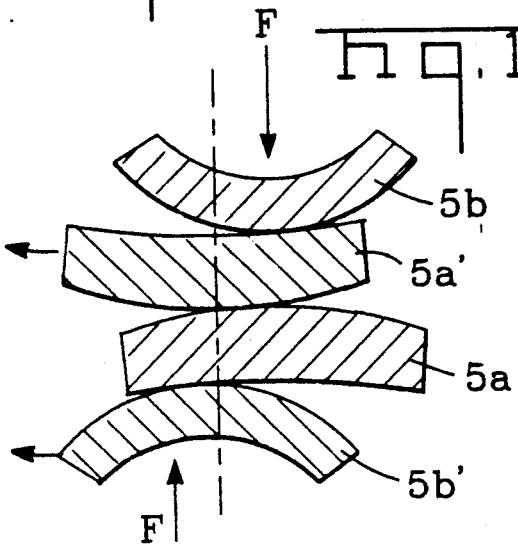
Fig. 13
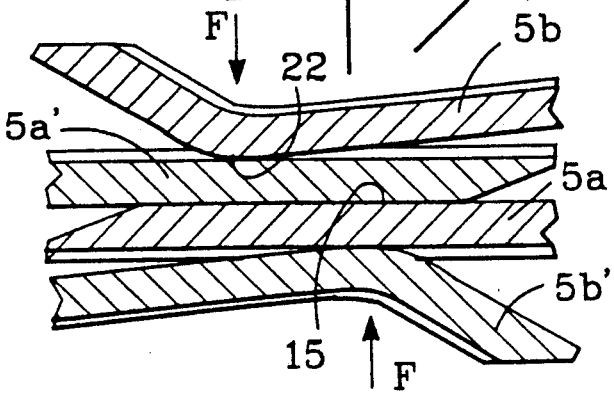

HERMAPHRODITIC ELECTRICAL CONNECTOR

BACKGROUND OF THE INVENTION

2. Field of the Invention

The invention relates to a terminal which is matable to a terminal which is identical in shape, typically referred to as a hermaphroditic terminal.

2. Description of the Prior Art

U.S. Pat. No. 4,820,182 to Harwath, et al. shows a hermaphroditic terminal which mates with itself. The terminal includes side by side contact arms with contact arm above, and one contact arm below, a horizontal plane. This terminal will mate with an identical terminal when the identical terminal is rotated 180° about its axial centerline. This causes the lower contact arms to mate with a lower rearward surface on the mating contact, and the upper contact to mate with an upper rearward surface on the mating contact.

The disadvantage to a contact system of this type is that the width of the contact system, as shown in FIG. 1, is at least twice the width of the contact arms, and possibly three times the width of a single contact arm. In a power distribution system for example, space is at minimum, and if an 8 or 10 wire system is utilized, the width of a connection system utilizing the terminal taught by the Harwath, et al. patent would quickly multiply.

An object of the invention then is to design a hermaphroditic electrical terminal for the power distribution market, in which the terminals are capable of carrying the current rating of 90° C. rated solid or stranded copper conductors in accordance with the National Electric Code for 18, 16, 14, 12 and 10 AWG wire and which utilizes a minimum amount of space, and is confined to a small envelope.

BRIEF DESCRIPTION OF THE DRAWINGS

FIG. 3 shows the terminals of FIG. 1 in a hermaphroditic housing with the one another.

FIG. 8 shows the two connectors of FIG. 7 in a mated relation.

FIG. 9 is a fragmentary perspective view of the contact portion of one terminal.

FIG. 10 is a cross-sectional view through lines 10-10 of FIG. 1.

FIG. 11 is a cross-sectional view through lines 11-11 of FIG. 2, showing lines of force acting on the mated contacts.

FIG. 12 is a view similar to FIG. 11 showing the lines of force acting when the one mated terminal is cocked or rotated relative to the other.

FIG. 13 is a sectional view of the mated contacts.

DETAILED DESCRIPTION OF THE PREFERRED EMBODIMENT

Figure 1:
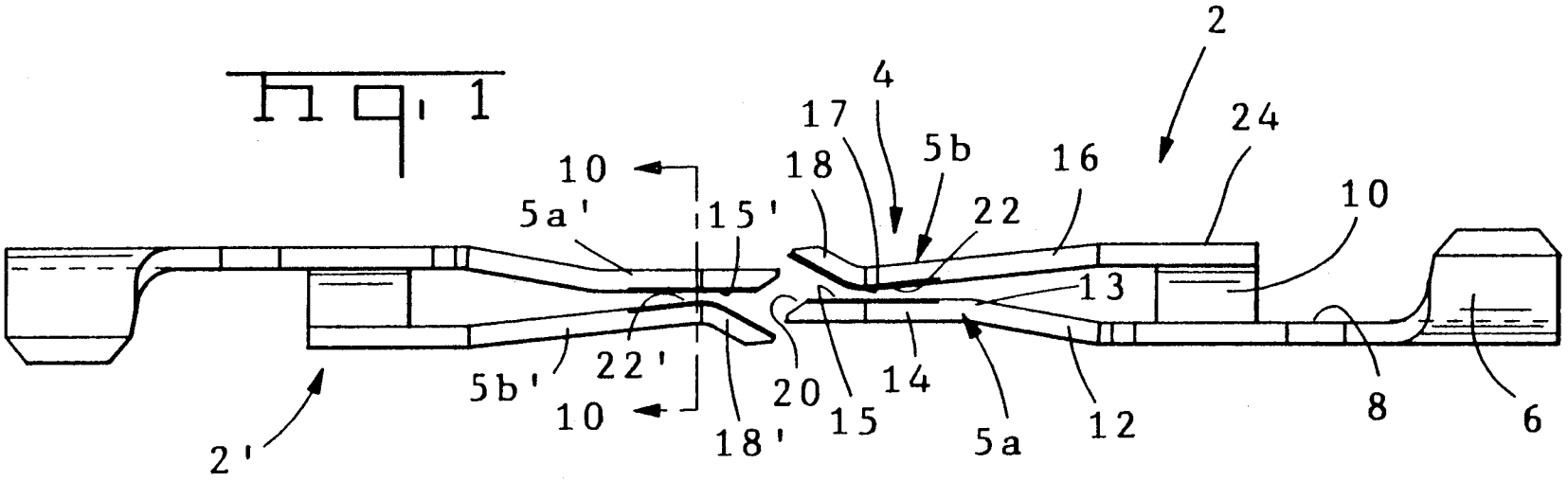
FIG. 1 shows a side plan view of the two hermaphroditic electrical of the instant invention poised for mating with one another.

With reference first to FIG. 1, the hermaphroditic electrical terminal 2 of the present invention has a forward contact portion 4 and a wire connecting section 6. Primed reference numerals are used to denote corresponding elements of the mating terminal. The contact terminals can be formed of high conductivity copper alloys available from Olin Brass and are preferably tin planted or silver plated. Lubricants available from Sanchem, Inc. are preferably used on the mating terminals to inhibit corrosion. The terminal 2 includes a base section 8 having an integral bight portion 10, the bight portion 10 thereby forming an upper plate section 24 in substantial parallel relation with the base section 8. The contact portion 4 is formed as an extension of the base section 8 and the upper plate portion 24. A lower contact arm 5*a* extends from the base section 8 via an inclined section 12, and further continues into a generally horizontal contact section 14. The free end of the planar contact section is chamfered inwardly to form lead-in section 20.

A second contact arm 5*b* is formed which extends from the upper plate 24 via an inclined section 16, which is directed towards the first or lower contact arm 5*a* . It should be noted that the inclined section 16 extends beyond the corner 13 formed, between the section 12 and 14, and continues towards the section 14. At a position proximate the free end of the contact arm 5*b* , the arm is turned up to form a radius 17, a radiused contact portion 22 there beneath, and a lead-in section 18.

With respect now to FIG. 10, which is a cross-sectional view of the opposed contacts 5*a'* and 5*b'* (identical components of identical terminal 2'), shows that the generally horizontal contact section is coined in the longitudinal direction to form a slight radius of curvature on contact surface 15 and 15'. The contact arm 5*b* is stamped and formed such that at the radius 17, the inner surface 22 and 22', the surface takes on a radius of curvature as shown in FIG. 9. Remembering that the surface 22 is rounded as viewed in FIG. 1, the radius of curvature at surface 22 causes the contact surface to take on a hemi-spherical shape as best shown in FIG. 9.

Figure 2:
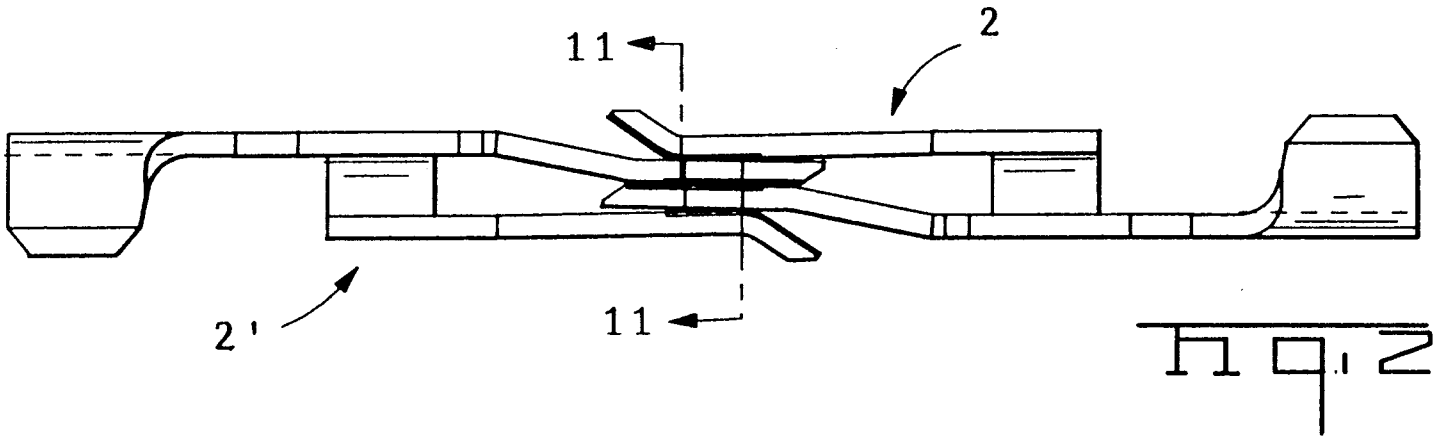
FIG. 2 terminals of FIG. 1 in a mated condition.
Figure 1:
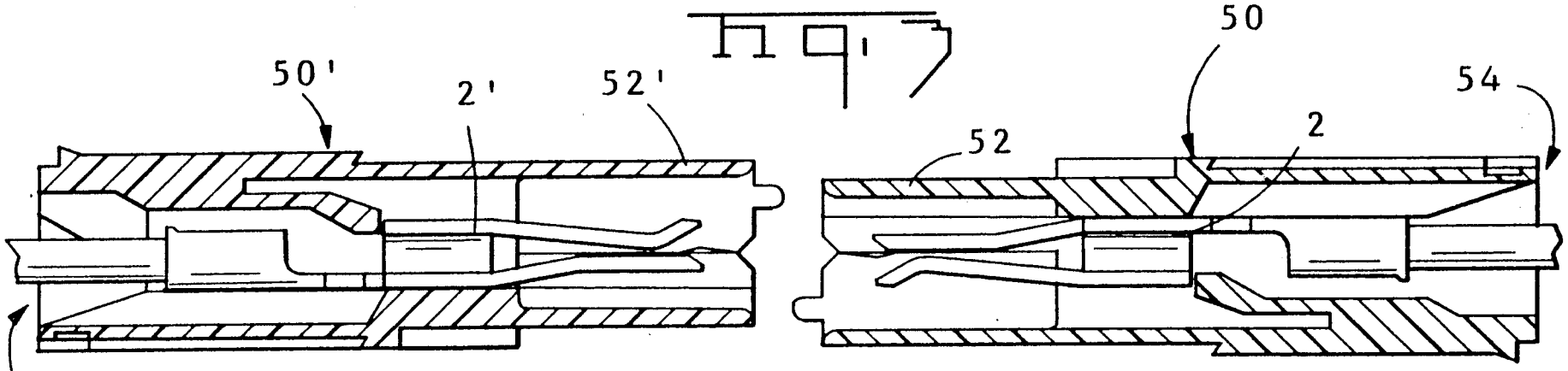
Figure 4:
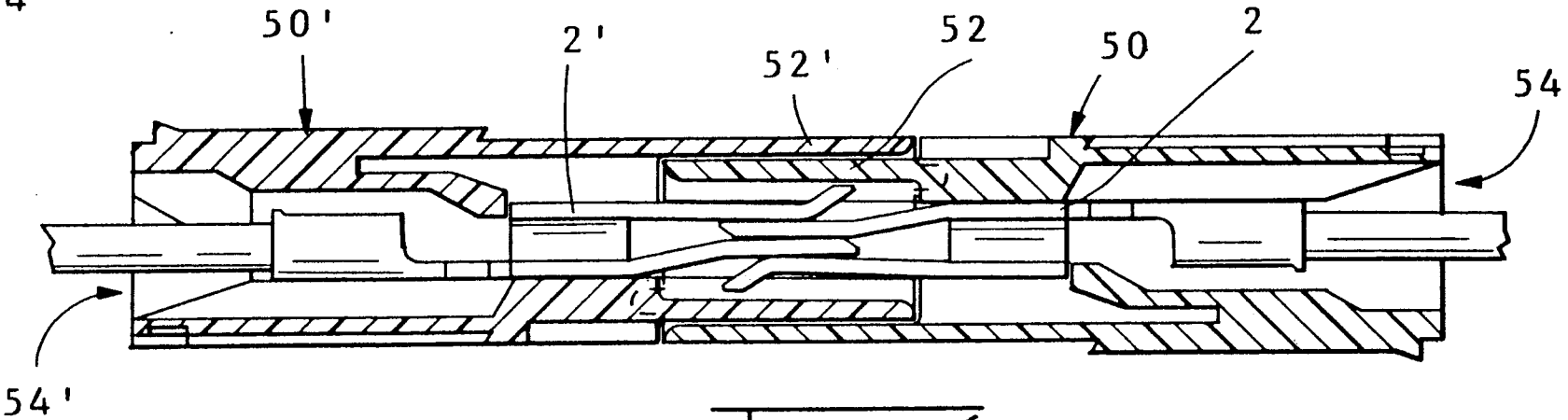
FIG. 4 shows the two connectors of FIG. 3 in a mated relation.
Figure 5:
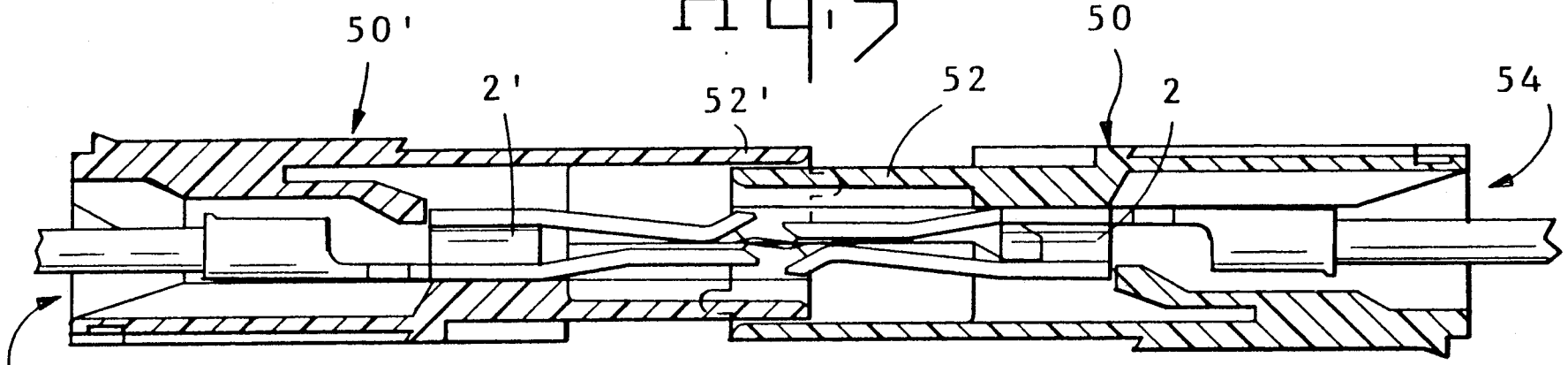
FIG. 5 the two housings of FIG. 3 where the terminals are in a worst case condition with the terminals rotated within their respective housings to the full clockwise extent possible.
Figure 6:
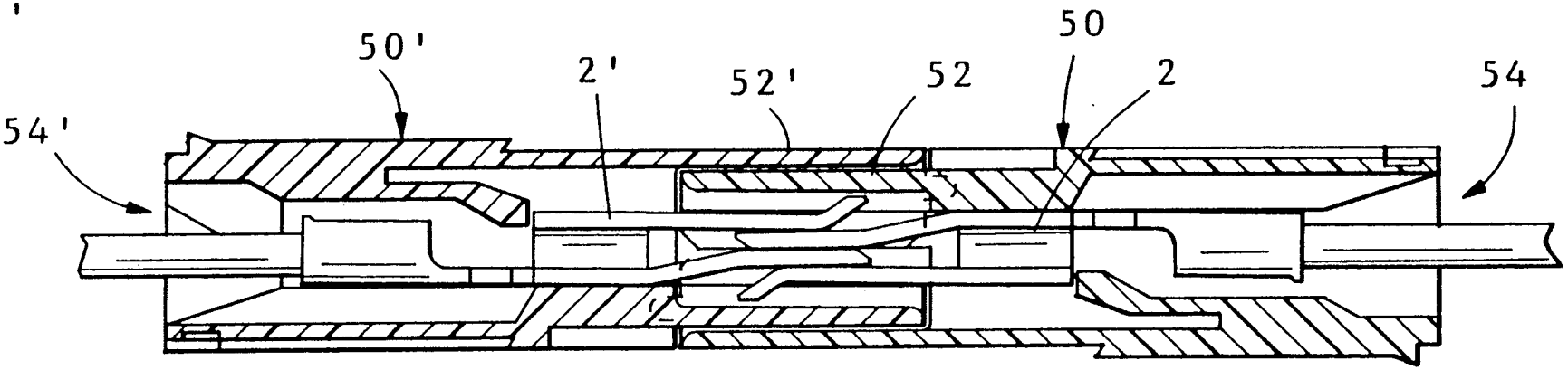
FIG. 6 shows the two connectors of FIG. 5 in mated condition.
Figure 7:
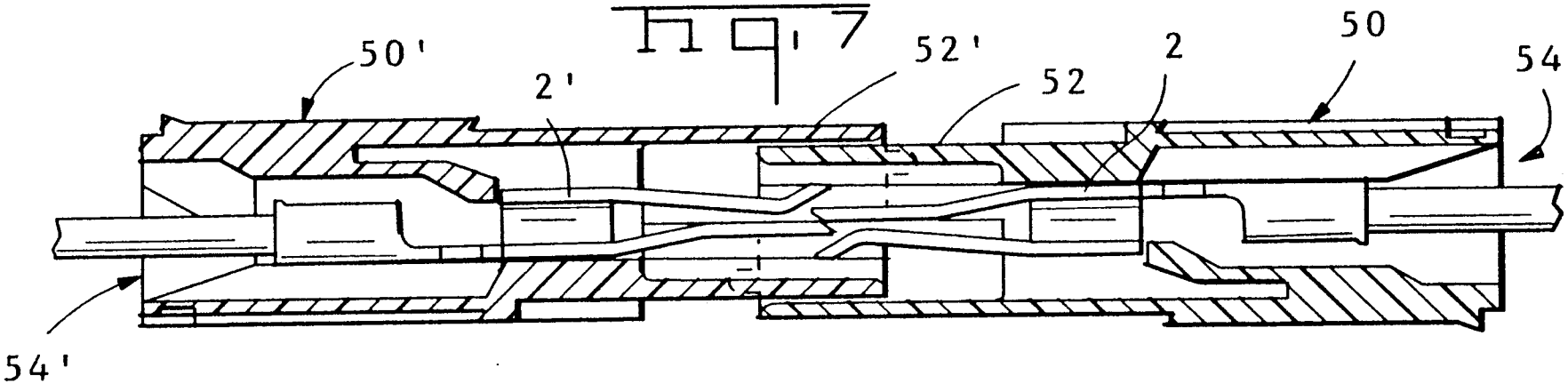
FIG. 7 shows the two housing of FIG. 3 where the terminals are in a worst case condition with the terminals rotated within their respective housings to the full counter clockwise extent possible.
Figure 1:
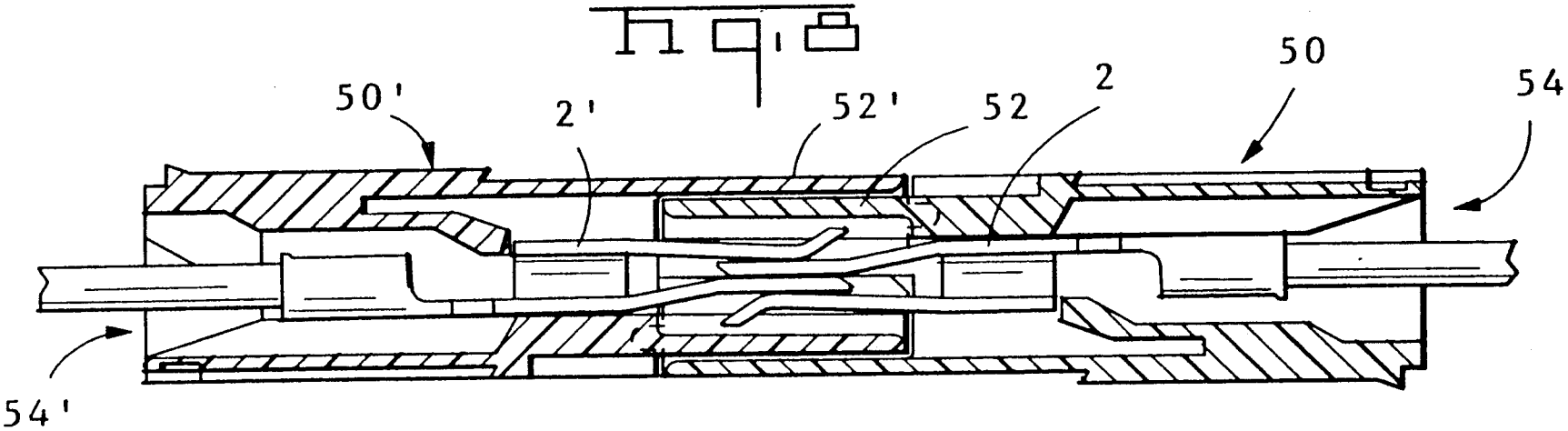

As shown in FIG. 1, as the two contact members 2 and 2', are urged towards each other, the free end of contact arm 5*a* abuts lead-in 18' while the free end of contact arm 5*a'* will abut the lead-in 18, causing the mating of the two contacts into the position shown in FIG. 2. In the mated position, it should be understood that the two mating longitudinal contact surfaces 5*a* and 5*a'* form longitudinal lines of contact with each other. It should also be noticed from FIG. 10, that the contact arms 5*b* and 5*b'* form point contacts on the upper surfaces of contact arms 5*a* and 5*a'* .

The line contact formed by the radiused contact surfaces 5*a* and 5*a'* is held in static equilibrium because the convex coined surface on contact 5*b* is received within the concave coined surface on the contact 5*a'* of the complementary terminal, and the convex coined surface in contact 5*b'* is received within the concave coined surface on contact 5*a* as shown in FIG. 11. In other words, each outer contact arm 5*b* or 5*b'* holds the inner arm 5a' or 5a respectively of the other terminal in alignment with its integral inner contact arm 5a or 5a' respectively. Thus, a longitudinal line contact in static equilibrium is maintained along the coined surfaces.

FIGS. 11–13 demonstrate the manner in which point and line contacts are formed so that the electrical interface is not degraded by slight variations in the orientation of the contacts which would be expected for the mated terminals. As shown in FIG. 10, the radius of curvature of the coined surface 15' on contact arm 5a' is less than the radius of curvature of the coined surface 22' on the horizontal contact arm 5b' . In other words, the curvature of the coined surface 22 is greater than the curvature on the coined surface 15. Therefore, the convex portion of surface 15 will engage the concave coined 2 surface 22' on the other terminal 2' in a single centralized location. Although this contact will be within a small area, this centralized contact can effectively be referred to as a point contact.

The point contact between each inclined arm 5b and 5b' and the concave coined surface of the horizontal arm is especially significant when one of the terminals is rocked, rotated or shifted relative to the other. Because a precise, definable contact point is established between each inclined arm and each horizontal arm, the force applied when the terminals are mated will always act through two single contact points. Even if the resultant force does not intersect the line contact between the inner convex mating surfaces on horizontal contact arms 5a and 5a' , the cantilever beams will remain substantially rigid, thus transmitting the entire contact force through the line contact. Note that the applied forces in the configuration shown in FIG. 12 are not aligned and each force is transmitted through a contact point slightly offset from the line contact. The forces F are transmitted through points on opposite sides of the line contact. The intended contact force for the preferred embodiment is equal to approximately 2.7 pounds. If the inclined contact arms 5b and 5b' were to engage the horizontal contact arms 5a' and 5a , respectively, along a line or at multiple points on a line transverse to the line contact between the convex coined surfaces on contact arms 5a and 5a' , it would not be possible to control the contact force as the terminals are mutually rotated.

We claim:

1. A hermaphroditic electrical terminal for interconnection to a like terminal, the terminal comprising a base portion having a bight portion integral therewith, the terminal having a first contact arm extending from the base portion and a second contact arm extending from the bight portion generally overlying the first contact arm, the terminal being characterized in that:

the first and second contact arms extend toward each other for a distance, where the first contact arm extends into a generally horizontal flat contact section, and the second contact arm continues toward the first contact arm to a position proximate a free end of the first contact arm, the second contact arm thereafter being bent away from the first contact arm, to form a radiused contact section proximate to the free end of the first contact arm, the first contact arm is coined along its longitudinal length to define a concave cross-section having the radius of curvature on the exterior of the first contact arm.

2. The terminal of claim 1 wherein the free end of the first contact arm is chamfered inwardly.

3. The terminal of claim 1 wherein the base portion includes an integral wire connection portion extending therefrom.

4. A hermaphroditic electrical connection comprising two like electrical terminals, each terminal comprising first and second contact arms wherein the first contact arm has a generally flat longitudinal contact section, and wherein the second contact arm includes a ramped portion extending towards the first contact arm, the two like terminals being interconnected with the first contact portion of the second terminal being sandwiched between the first and second contact portions of the first terminal, and the first contact portion of the first terminal being sandwiched between the first and second contact portions of the second terminal, whereby the second contact arms of the first and second terminals co-actively spring load the first contact arms into static equilibrium, the first contact arms are coined along their longitudinal length to define concave cross-sections having the radius of curvature on the exterior of the first contact arms.

5. The terminal of claim 4 wherein the second contact arms include radiused contact sections which form at the free ends of the second contact arms, lead-in sections for the first contact sections.

6. The terminal of claim 5 wherein the free ends of the first contact arms are chamfered inwardly.

7. A hermaphroditic electrical terminal for interconnection to a like terminal, the terminal having inner and outer contact arms, each contact arm having a coined contact surface, each contact surface having a convex coined side and a concave coined side, the curvature of the convex side of the outer arm being greater than the curvature of the concave side of the inner arm, so that when two hermaphroditic electrical terminals are mated, force can be transmitted from the outer contact arm of one terminal to the inner contact arm of the other terminal where the coined convex side of the outer arm engages the coined concave side, having less curvature than the engaged convex side, of the inner arm on the other terminal.

* * * * *